United States Patent [19]

Tada

[11] Patent Number: 4,691,849

[45] Date of Patent: Sep. 8, 1987

[54] MANUALLY OPERATED TRIGGER TYPE DISPENSER

[76] Inventor: Atsushi Tada, 2-6-3 Kakinokizaka, Meguro-ku, Tokyo 152, Japan

[21] Appl. No.: 805,272

[22] Filed: Dec. 5, 1985

[51] Int. Cl.[4] ..... B67D 5/40; B05B 9/043

[52] U.S. Cl. ..... 222/382; 222/383; 239/333

[58] Field of Search ..... 222/384, 377, 380, 382, 222/383, 405, 478, 372; 239/333

[56] References Cited

U.S. PATENT DOCUMENTS

| | | | |
|---|---|---|---|
| 2,645,386 | 7/1953 | Bobrick . | |
| 2,693,899 | 11/1954 | Trout . | |
| 3,062,416 | 11/1962 | Cooprider | 222/478 X |
| 3,768,734 | 10/1973 | Anderson, Jr. et al. | 239/333 |
| 3,840,157 | 10/1974 | Hellenkamp | 222/309 |
| 4,161,288 | 7/1979 | McKinney | 222/380 X |
| 4,227,650 | 10/1980 | McKinney | 239/333 |
| 4,358,057 | 11/1982 | Burke | 222/380 X |
| 4,371,097 | 2/1983 | O'Neill | 222/321 |

FOREIGN PATENT DOCUMENTS

| | | | |
|---|---|---|---|
| 806929 | 6/1951 | Fed. Rep. of Germany | 222/382 |
| 1005217 | 4/1952 | France | 222/382 |

*Primary Examiner*—Joseph J. Rolla
*Assistant Examiner*—Nils E. Pedersen
*Attorney, Agent, or Firm*—Frishauf, Holtz, Goodman & Woodward

[57] ABSTRACT

A dispenser body molded of plastic material includes an upper body portion on which a trigger is swingably pivoted and a vertically extending lower tubular portion. A piston has an L shape and includes an upper folded horizontal portion carried by spaced vertical wall portions of the upper body portion. The piston is vertically disposed in the upper body portion. A nozzle member is mounted on the terminal end of the upper folded horizontal portion. An outlet conduit, communicating with an orifice formed in the nozzle member, is formed in the piston. A cylinder coupled to the trigger is disposed to slide vertically along the piston within the lower tubular portion. The cylinder defines a pump chamber communicating with the outlet conduit. An inlet conduit communicating with the pump chamber is formed in the cylinder. A compression spring, seated in the cylinder at the lower end thereof and abutting on the lower end of the piston at upper end thereof, biases the cylinder to its lower non-operation position.

9 Claims, 8 Drawing Figures

MANUALLY OPERATED TRIGGER TYPE DISPENSER

BACKGROUND OF THE INVENTION

1. Field of the Invention

This invention relates to a manually operated trigger type dispenser which is adapted to be detachably attached to a liquid container.

2. Description of the Prior Art

The prior art manually operated trigger type dispenser generally comprises a dispenser body which is adapted to be detachably attached to the neck of a receptacle or container. The dispenser body is molded of plastic material such as polyethylene.

The dispenser body includes an upper body portion to which an actuating lever or trigger is swingably pivoted and a downwardly extending tubular portion or lower tubular portion which is adapted to be attached to the neck of the container by a cap or directly. Generally, the lower tubular portion extends from the upper body portion almost at right angles. A cylinder defining a pump chamber therein is disposed in the dispenser body. An inlet conduit, communicating with the container and the pump chamber and having an axis extending vertically, is disposed in the dispenser body. A discharge or outlet conduit, communicating with the pump chamber and having an axis substantially perpendicular to the vertical axis of the inlet conduit, is also disposed in the dispenser body.

In general, the inlet conduit and the outlet conduit are respectively disposed in the lower tubular portion and the upper body portion, and their axes nearly perpendicular to each other. The cylinder is integrally molded with the upper body portion in concentric with the outlet conduit, and a piston coupled to a trigger reciprocates horizontally in the cylinder.

As disclosed in, for example, U.S. Pat. No. 3,840,157 (Hellenkamp) and U.S. Pat. No. 4,227,650 (McKinney), there is another trigger type dispenser whose cylinder is integrally molded with the upper body portion having a tubular horizontal portion, in which the outlet conduit is disposed. The cylinder extends vertically and has a piston which reciprocates vertically therein. In this type of dispenser, the inlet conduit is formed in the piston, not in the lower tubular portion. But, the axis of the cylinder integrally molded with the upper body portion extends in the direction perpendicular to the axis of the outlet conduit.

As disclosed in U.S. Pat. No. 4,371,097 (O'Neil), another trigger type dispenser is also known in which the piston is vertically arranged in the dispenser body and the cylinder reciprocates vertically along the piston. In this dispenser, the outlet conduit is formed in the upper body portion, and the inlet conduit is formed in the cylinder, not in the lower tubular portion. But, tubular portions having axes perpendicular to the axis of the outlet conduit, depend from the upper margin of the upper body portion.

When a dispenser body includes only one tubular portion, it can be easily molded by moving a movable mold with respect to a stationary mold. In the above-mentioned conventional dispensers, however, the dispenser body includes two tubular portions arranged perpendicular to each other, namely, the upper body portion and lower tubular portion, or the upper body portion and the cylinder integrally molded with the upper body portion, or the upper body portion and the tubular portion depending from the upper body portion. Therefore, core pins need to be moved in the direction perpendicular to the direction of the movement of the movable mold, for example, in the direction Y shown in FIG. 8 or in the reverse direction. Therefore, only a single pair of cavities 2 can be formed for the dispenser body on the stationary mold 4 in the direction Y, creating a large dead space at the center portion of the stationary mold 4. Naturally, the number of dispenser bodies molded for each injection cycle is limited.

Of the components of the dispenser, the dispenser body has a complicated structure as compared with the piston, cylinder, trigger, etc. Molten plastic material is injected into the cavities 2 under high injection pressure. But, because the shapes of the cavities 2 are complex, the molten plastic material will not quickly fill up the cavities, increasing the injection time. Further, the time for moving the core pins is involved in the injection cycle, thus making the injection cycle longer.

According to the conventional dispensers, because of a small number of molded articles in each injection cycle and of a longer injection cycle, it is difficult to realize mass production of the dispenser bodies. This results in a higher production cost of the dispenser bodies and the trigger type dispensers as a consequence.

SUMMARY OF THE INVENTION

It is therefore a primary object of the invention to provide a manually operated trigger type dispenser which comprises a dispenser body having a simple construction suitable to be molded in a shorter injection cycle.

It is a further object of the invention to provide a manually operated trigger type dispenser which is readily assembled from less molded components.

To achieve the objects, according to the invention, the inlet conduit and outlet conduit are not formed in the dispenser body. One of the conduits is disposed in the cylinder and the other in the piston.

According to one preferred embodiment of the invention, the dispenser comprises a dispenser body made of plastic material, and the dispenser body includes an upper body portion and a downwardly extending lower tubular portion which are integrally molded with the dispenser body. An L-shaped piston is disposed vertically in the upper body portion, and the upper folded horizontal portion of the piston is supported by a pair of vertical wall portions extending from the upper margin of the upper body portion. A cylinder coupled to a trigger, which is swingably attached to the upper body portion, is disposed in the lower tubular portion so as to be able to reciprocate in the vertical direction along the piston.

According to another preferred embodiment of the invention, the cylinder is made of plastic material separately from the dispenser body. To be specific, the cylinder having an L shape is disposed vertically in the upper body portion, and the upper folded horizontal portion of the cylinder is supported by a pair of vertical wall portions extending from the upper body portion. The piston coupled to the trigger, which is swingably attached to the upper body portion, is disposed in the lower tubular portion in such a manner that the piston can reciprocate in the cylinder.

Other objects, advantages and novel features of the invention will become more apparent from the following detailed description of the invention when taken in conjunction with the accompanying drawings.

DETAILED DESCRIPTION OF THE PREFERRED EMBODIMENTS

Figure 1:
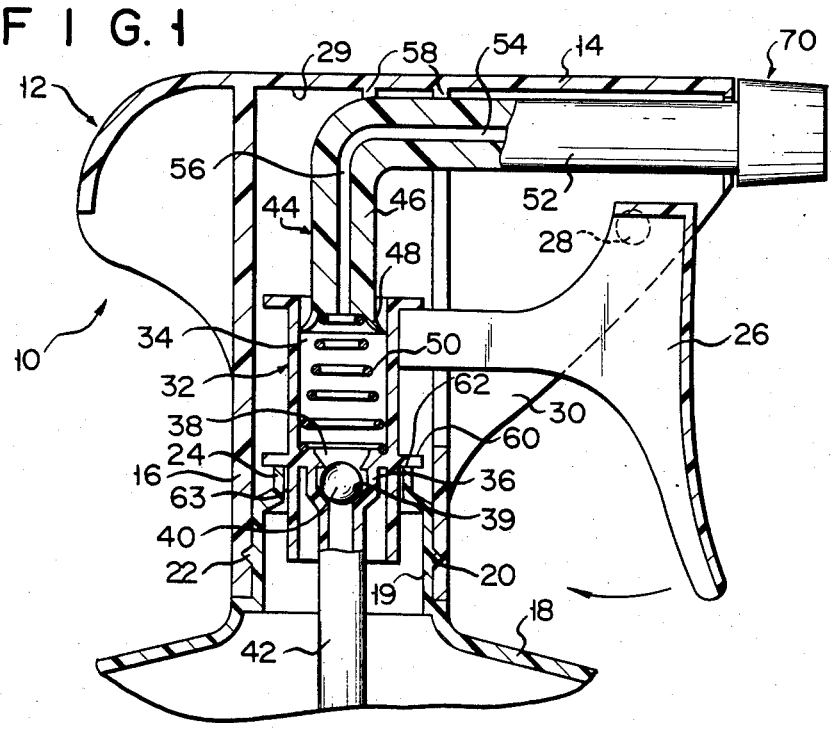
FIG. 1 is a longitudinal sectional view of a manually operated trigger type dispenser according to one preferred embodiment of the invention, with the cylinder being in its non-operation position.

The same reference numerals refer to like and corresponding components throughout accompanying drawings.

As shown in FIG. 1, a manually operated trigger type dispenser 10 according to the invention comprises a dispenser body 12 which is molded of plastic material such as polyethylene. The dispenser body 12 includes an upper body portion 14 and a lower tubular portion 16 perpendicularly extending from the upper body portion. The lower tubular portion 16 is adapted to be detachably attached to a neck 19 of a receptacle or container 18 which contains liquid to be dispensed. In the embodiment, an engaging concave portion 20 is formed at the bottom end of the lower tubular portion 16 and is engaged to an engaging projection 22, formed in the neck 19 so as to directly attach the dispenser body 12 to the container 18. Of course, the lower tubular portion 16 of the dispenser body may be provided with another engaging means, such as an internal threaded portion and may be engaged with the neck 19, which is externally threaded, thereby attaching the dispenser body 12 to the container 18.

The neck 19 has at its distal end a small diameter section 24, in which a cylinder is laterally slidable.

A trigger 26 is swingably attached to the upper body portion 14 of the dispenser body 12. In the embodiment, the trigger 26 includes a pair of externally extending pivot pins 28 which are integrally formed on the associated side walls of the trigger. The pivot pins 28 fit in partially circular support holes formed in spaced vertical wall portions 30, which vertically extend from an upper margin 29 of the upper body portion 12. With this arrangement, the trigger 26 can be swung on the pivot pins 28.

A cylinder 32 defines a pump chamber 34 inside and includes at its bottom portion a small diameter section 36, in which an inlet conduit 38 is disposed. A valve seat 39 is formed in the small diameter section 36 of the cylinder 32 and an inlet check valve 40 such as a steel ball is received in the small diameter section 36. A dip tube or suction tube 42 is integrally formed in the small diameter section 36 and extends to the interior of the container 18. As the suction tube 42 is integrally molded with the cylinder 32, the number of independent components of the dispenser 10 decreases, thereby facilitating the assembling of the dispenser. Moreover, because the cylinder 32 houses the inlet check valve 40 and is provided with the suction tube 42, it is unnecessary to use a valve case. This simplifies the structure of the dispenser body 12 as compared with conventional dispensers which have the valve case integrally molded with the dispenser body.

The cylinder 32 is coupled to the trigger 26, so that the swing movement of the trigger causes the cylinder to vertically reciprocate along a piston 44.

The cylinder 32 has an opened upper end through which a vertically extending lower portion 46 of the piston 44 is inserted in the cylinder. A flared seal 48 is integrally molded with the lower end of the piston 44 so as to slidably abut on the inner wall of the cylinder 32. A bias means 50 such as a compression coil spring is seated in the cylinder 32 and its upper end abuts on the lower end of the piston 44.

The piston 44 is made of plastic material in an L shape and includes an upper folded horizontal portion 52. A discharge or outlet conduit 54, which communicates with an orifice of a nozzle means to be described later, is disposed in the upper folded horizontal portion 52. A connecting conduit 56, which communicates the outlet conduit 54 with the pump chamber 34, is formed in the vertically extending lower portion 46 of the piston 44, i.e., in the piston body. The piston 44 may easily be modified from a linear shape to an L shape by pressing the to-be-folded portion of the piston while heating that portion. The upper folded horizontal portion 52 of the piston 44 is carried by the pair of spaced vertical wall portions 30 of the upper body portion 14.

The horizontal portion 52 abuts against members 58, downwardly extending from the inner wall of the upper body portion 14, by the urging force of the compression coil spring 50, and the cylinder 32 is urged downward by the urging force. Then, an outward flange or enlargement 60 formed at the bottom end of the cylinder 32 is pressed down onto an upper margin 62 of the neck 19 of the container 18 so as to ensure liquid tight seal between the enlargement and the neck. Therefore, liquid leakage from the neck 19 can be prevented even when the container 18 is tilted at the non-operation position or at rest position of the dispenser 10 shown in FIG. 1. Because the enlargement 60 integrally formed in the cylinder 32 acts as a packing member, it is unnecessary to provide an independent packing member.

The cylinder 32 is slidable in the small diameter section 24 of the neck 19, because there is a clearance or gap 63 between the cylinder and the small diameter section. The gap 63 acts as a venting means to prevent fluid lock from being created in the interior of the container 18.

Figure 2:
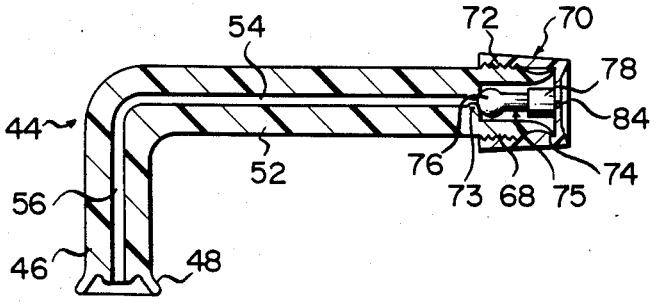
FIG. 2 is a longitudinal sectional view of an L-shaped piston.

As shown in FIG. 2, the piston 44 includes an external threaded portion 68 at the terminal end of the horizontal portion 52 and is engaged with a nozzle means 70 including an internal threaded portion 72. A flared seal 74 slidably contacting the inner wall of the nozzle means 70 is provided at the distal end of the piston 44. A valve seat 73 for an outlet check valve is also provided at the distal end of the piston 44.

Figure 3:
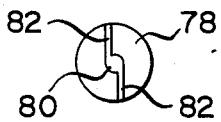
FIG. 3 is a right side view of a spinner assembly.

A spinner assembly 75 is disposed at the distal end of the piston 44. The spinner assembly 75 is made of plastic material and includes an outlet check valve 75, adapted to abut on the valve seat 73, at its one end and a spinner 78 at the other end to swirl pressurized liquid. As shown in FIG. 3, a circular concave portion 80 is formed at the central portion of the distal end of the spinner 78, and a pair of grooves extends in the tangential direction of the concave portion. The concave portion 80 faces a central orifice 84 formed at the base of the nozzle means 70.

When the nozzle means 70 is rotated and moves leftward to press the outlet check valve 76 onto the valve seat 73, the outlet check valve is closed as shown in FIG. 2 to thereby prevent the liquid from dispensing through the orifice 84.

The dispenser 10 having the aforementioned structure will be operated as follows.

First, when the nozzle means 70 is rotated to move rightward from the position shown in FIG. 2, the outlet check valve 76 is separated from the valve seat 73 to be opened. Then, the trigger 26 swings in the direction of the arrow in FIG. 1 on the pivot pins 28 against the biasing force of the compression spring 50. The movement of the trigger 26 raises the cylinder 32 in contact with the seal member 48 (see FIG. 4). As the cylinder 32 rises, the volume of the pump chamber 34 decreases, and the air in the pump chamber is compressed as a consequence and is discharged from the orifice 84 through the connecting conduit 56 and outlet conduit 54. During the upward movement of the cylinder 32, the inlet check valve 40 is pressed against the valve seat 39 by its own weight and the compressed air and is closed. When the force for squeezing the trigger 26 is released, the trigger swings back in the direction opposite to the arrowed direction by the force of the spring 50 and the cylinder 32 moves downward to return to the non-operation position as shown in FIG. 1. With the downward movement of the cylinder 32, the volume of the pump chamber 34 increases, thus producing the negative pressure in the pump chamber. The negative pressure separates the inlet check valve 40, against its weight, from the valve seat 39. As a result, the liquid in the container 18 is sucked up in the pump chamber 34 through the suction tube 42 and the inlet check valve 40. The negative pressure also pulls the spinner assembly 75 and presses the outlet check valve 76 against the valve seat 73 so as to close the outlet check valve.

After the liquid is supplied into the pump chamber 34, the trigger 26 is again swung in the arrowed direction in FIG. 1 so as to raise the cylinder 32. When the liquid flows into the pump chamber 34, the inlet check valve 40 is pressed against the valve seat 42 to be closed. The rising of the cylinder 32 pressurizes the liquid in the pump chamber 34. The pressurized liquid flows into the circular concave portion 80 through the tangential grooves 82 of the spinner 78 which is pressed toward the rear side of the nozzle means 70 (see FIG. 3). When flowing into the concave portion 80 from the grooves 82, the pressurized liquid is swirled and is then sprayed from the orifice 84.

The pressurized liquid may also be discharged without being swirled. For example, a stopper for limiting the rightward movement of the spinner assembly 75 can be provided at the piston 44 at the right of the valve seat 73, so that when the nozzle means 70 moves rightward, the outlet check valve 76 abuts on the stopper. With this arrangement, the spinner 78 is not pressed to the rear side of the nozzle means 70, thereby preventing the swirling of the liquid.

The nozzle means 70 and spinner assembly 75 are not limited to the illustrated arrangements but can have different structures.

Figure 4:
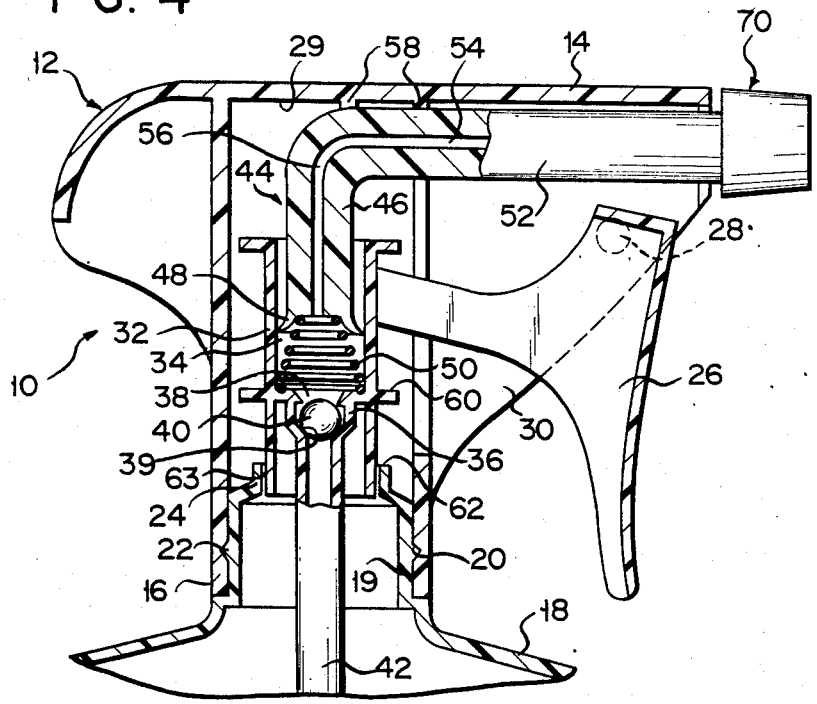
FIG. 4 is a longitudinal sectional view of a manually operated trigger type dispenser according to one preferred embodiment of the invention, with the cylinder being in its operation position.

At the non-operation position of the trigger 26, i.e., at the non-operation of the dispenser 10, as shown in FIG. 1 the enlargement 60 of the cylinder 32 is in close contact with the upper margin 62 of the neck 19 by the biasing force of the spring 50, so that liquid tight seal is provided between the enlargement 60 and the upper margin 62. Therefore, the interior of the container 18 is sealed from the atmospheric air and the liquid leakage can be prevented. But, when the cylinder 32 moves upward in response to the movement of the trigger 26, the enlargement 60 is separated from the upper margin 62. Consequently, the air flows into the container 18 through the gap 63, as shown in FIG. 4. Therefore, fluid lock does not occur in the container 18.

Figure 8:
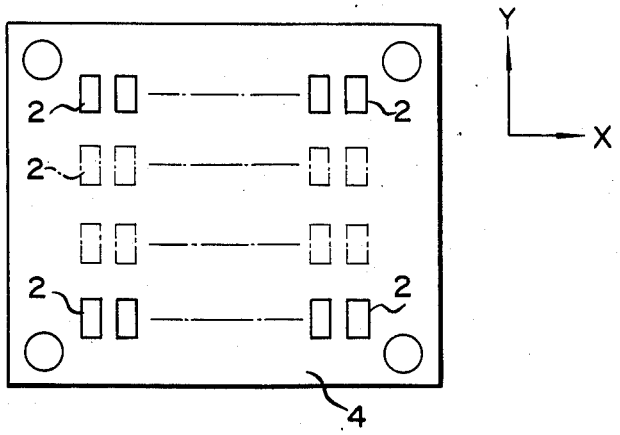
FIG. 8 is a schematic top plan view of a stationary mold for the dispenser body.

In the above-described embodiment, the cylinder 32 is formed separately from the dispenser body 12, and the inlet conduit 38 is formed in the cylinder and the outlet conduit 54 is formed in the L-shaped piston 44. That is, the dispenser body 12 has neither an inlet conduit nor an outlet conduit and has only the lower tubular portion 16 vertically extending downward. This simplifies the structure of the dispenser body 12 and shortens the injection cycle for the dispenser body. Further, because the outlet conduit 54 intersecting with the axis of the lower tubular portion 16 is not formed in the dispenser body 12, the dispenser body can be molded simply by moving the movable mold and without using a core pin for the outlet conduit 54. Therefore, it is not necessary to consider the direction of the movement of the core pin, and it is possible to provide three rows or more of cavities for the dispenser body in the stationary mold in the direction Y, thus ensuring effective use of the area of the stationary mold. For example, according to the conventional structure shown in FIG. 8, more than two rows of cavities 2 for the dispenser body cannot be formed in the stationary mold 4 in the direction Y, whereas in the present invention, two more rows of cavities 2, as indicated by one-dot chain lines, can be provided in the direction Y. As a result, the number of molded dispenser bodies in each injection cycle is doubled.

Because the cavities 2 for the dispenser body are simplified, the injection time for the dispenser body can be shortened. Moreover, because it is not necessary to use the core pin for the outlet conduit, the time for moving the core pin is not involved in the injection cycle, thus shortening the injection cycle.

As the number of molded dispenser bodies in each injection cycle increases and the injection cycle itself is shortened, mass production of the dispenser bodies becomes possible, reducing the manufacturing cost.

In addition, because the structure of the dispenser body, which is complicated as compared with the piston 44 and cylinder 32, is simplified and the mass production of the dispenser bodies becomes possible, the dispenser 10 can be produced at a lower cost.

In the aforementioned embodiment, after the piston 44 is molded in a linear shape, it is folded in an L shape. It is possible, however, to mold an L-shaped piston in order to omit the folding process.

Figure 5:
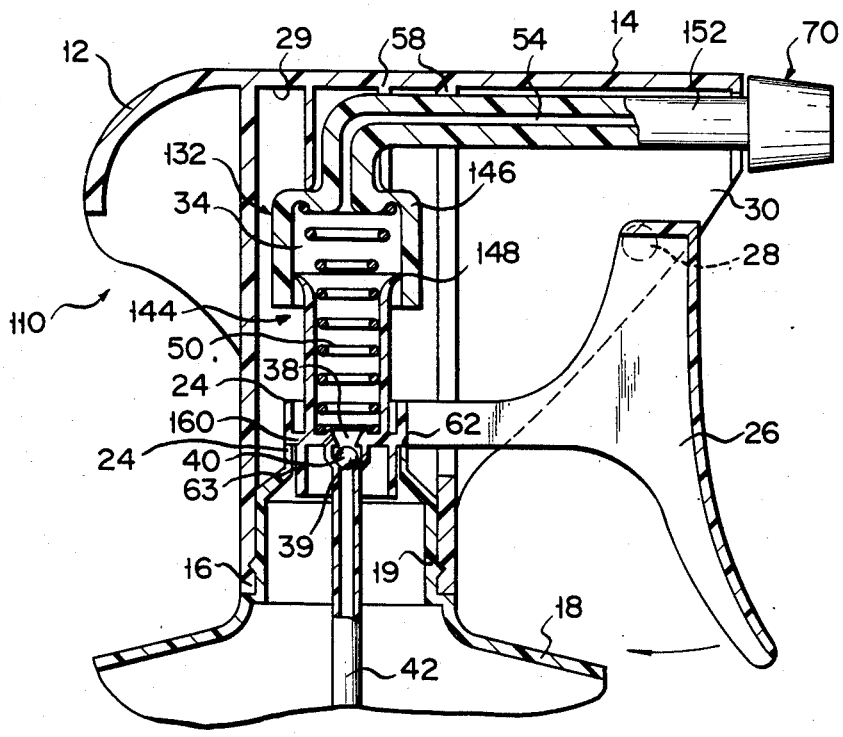
FIG. 5 is a longitudinal sectional view of a manually operated trigger type dispenser according to another preferred embodiment of the invention, with the cylinder being in its non-operation position.

The relative position between the piston and the cylinder may be modified as shown in FIG. 5. In the embodiment, a piston 144 is coupled to the trigger 26, so that the piston 144 moves up and down according to the movement of the trigger. In a dispenser 110 according to this embodiment, a cylinder 132 is made of plastic material in an L shape separately from the dispenser body 12 and includes an upper folded horizontal portion 152. The outlet conduit 54 is formed in the upper folded horizontal portion 152, and the pump chamber 34 is defined in a cylinder body 146. The cylinder 132 can be molded in a linear shape and then folded in an L shape or it can be molded as having an L shape. The inlet conduit 38 is formed in the piston 144, which has a flared seal 148 at one end and an enlargement 160 at the other end. The valve seat 39 is formed in the piston 144 and the inlet check valve 40 is housed in the piston. With these arrangements, the structure of the dispenser body 12 can be simplified. The suction tube 42 is integrally formed with the piston 144 and extends inside the container 18. This reduces independent components of the dispenser 110 and simplifies the assembling of the dispenser. Moreover, the bias means 50 is provided in the piston 144, so that the upper folded portion 152 of the cylinder 132 is pressed against the vertically extending members 58 by the force of the bias means and the enlargement 160 of the piston closely contacts the upper margin 62 of the neck 19 so as to provide fluid tight seal.

In the above embodiment, the outlet conduit 54 is formed in the L-shaped cylinder 132, which is formed separately from the dispenser body 12. And the dispenser body 12 has neither an inlet conduit nor an outlet conduit but has only the vertically extending lower tubular portion 16. This simplifies the structure of the dispenser body 12 and shortens the injection time for the dispenser body. The outlet conduit 54, intersecting the axis of the lower tubular portion 16, is not formed in the dispenser body 12, so that the area of the stationary mold can be effectively used and the number of the molded articles in each injection cycle increases as a consequence.

In this embodiment, mass production of the dispenser bodies is also possible, thus ensuring low cost dispenser bodies and low cost dispenser.

Figure 6:
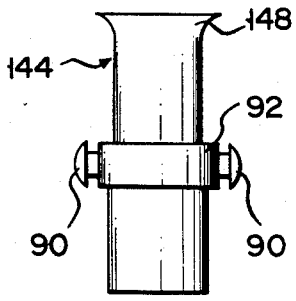
FIG. 6 is a front elevational view of a cylinder.
Figure 7:
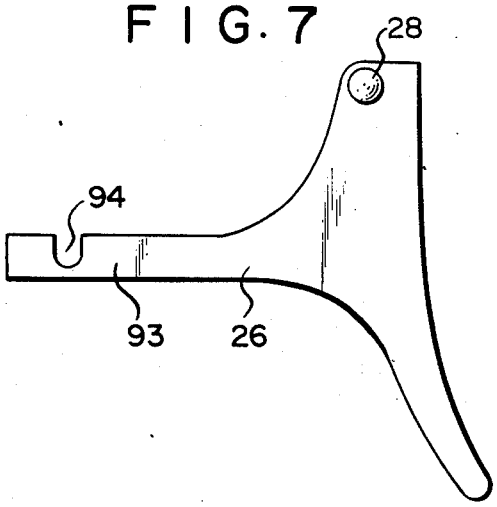
FIG. 7 is a left side view of a trigger.

The trigger 26 and piston 144 or cylinder 32 can be engaged in various manners. For example, in the second embodiment shown in FIG. 5, as shown in FIGS. 6 and 7, a pair of engaging members 90 is formed in an outward flange 92 of the piston 144 and engaging holes 94 formed in a bifurcated portion 93 of the trigger 26 are engaged with the associated engaging members 90. In this arrangement, the piston 144 can smoothly move up and down in accordance with the movement of the trigger 26.

What is claimed is:

1. A manually operated trigger type dispenser comprising:

a dispenser body adapted to be detachably mounted onto a neck of a container containing liquid to be dispensed, said dispenser body being molded of plastic material and including an upper body portion on which a trigger is swingably pivoted and a vertically extending lower tubular portion, a tube formed separately from the dispenser body in an L-shape having a horizontal portion thereof disposed in the upper body portion and a vertical portion thereof disposed in the vertically extending lower tubular portion, the lower end of said vertical portion having a piston disposed thereon, a cylinder defining a pump chamber, coupled to the trigger and disposed in the lower tubular portion to reciprocate along the piston between its upper operation position and its lower non-operation position, inlet conduit means formed in the cylinder and communicating with the pump chamber to enable flow of liquid therethrough from the container to the pump chamber, nozzle means mounted on the terminal end of the horizontal portion of said tube and including an orifice, outlet conduit means formed in the horizontal portion of said tube, and communicating with the pump chamber to dispense compressed liquid from the pump chamber through said orifice, and means for biasing the cylinder to its lower non-operation position.

2. A dispenser according to claim 1 in which the upper folded horizontal portion of the L-shaped piston is carried by means of spaced vertical wall portions depending from an upper margin of the upper body portion.

3. A dispenser according to claim 2 in which the nozzle means includes an internal threaded portion to be engaged with an external threaded portion formed on the terminal end of the upper folded horizontal portion.

4. A dispenser according to claim 2 in which an enlargement is integrally formed with the cylinder and is pressed onto an upper margin of the neck by the urging force of the bias means so as to ensure liquid tight seal between the enlargement and the neck.

5. A dispenser according to claim 4 in which the cylinder includes a small diameter section in which an inlet check valve is received, and a stop in said small diameter section above the inlet check valve.

6. A dispenser according to claim 1 in which the cylinder includes a suction tube integrally formed with the small diameter section.

7. A dispenser according to claim 1 in which an enlargement is integrally formed with the cylinder and is pressed onto an upper margin of the neck by the urging force of the bias means so as to ensure liquid tight seal between the enlargement and the neck.

8. A dispenser according to claim 1 in which the cylinder includes a small diameter section in which an inlet check valve is received.

9. A dispenser according to claim 1 in which the cylinder includes a suction tube integrally formed with the small diameter section.

* * * * *

UNITED STATES PATENT AND TRADEMARK OFFICE

CERTIFICATE OF CORRECTION

PATENT NO. : 4,691,849

DATED : September 8, 1987

INVENTOR(S) : TADA

It is certified that error appears in the above-identified patent and that said Letters Patent is hereby corrected as shown below:

Column 4, next-to-last line, "valve 75" should read --valve 76--.

Column 8, line 43, "according to claim 1" should read --according to claim 5--.

Signed and Sealed this

Twenty-sixth Day of April, 1988

*Attest:*

DONALD J. QUIGG

*Attesting Officer*

*Commissioner of Patents and Trademarks*